US009534275B2

(12) United States Patent
Chevrier et al.

(10) Patent No.: US 9,534,275 B2
(45) Date of Patent: Jan. 3, 2017

(54) METHODS AND SYSTEMS FOR REDUCING CHROMIUM CONTAINING RAW MATERIAL

(71) Applicants: Vincent F. Chevrier, Charlotte, NC (US); Russell Kakaley, Charlotte, NC (US)

(72) Inventors: Vincent F. Chevrier, Charlotte, NC (US); Russell Kakaley, Charlotte, NC (US)

(73) Assignee: Midrex Technologies, Inc., Charlotte, NC (US)

( * ) Notice: Subject to any disclaimer, the term of this patent is extended or adjusted under 35 U.S.C. 154(b) by 321 days.

(21) Appl. No.: 14/199,266

(22) Filed: Mar. 6, 2014

(65) Prior Publication Data

US 2014/0251084 A1 Sep. 11, 2014

Related U.S. Application Data

(60) Provisional application No. 61/773,502, filed on Mar. 6, 2013.

(51) Int. Cl.
*C22B 34/32* (2006.01)

(52) U.S. Cl.
CPC ..... *C22B 34/32* (2013.01)

(58) Field of Classification Search
CPC ..... C22B 34/32
USPC ..... 75/10.18, 10.34, 10.67, 623
See application file for complete search history.

(56) References Cited

U.S. PATENT DOCUMENTS

| | | | |
|---|---|---|---|
| 5,567,224 | A | 10/1996 | Kundrat |
| 5,730,775 | A | 3/1998 | Meissner et al. |
| 6,270,552 | B1 | 8/2001 | Takeda et al. |
| 6,413,295 | B2 | 7/2002 | Meissner et al. |
| 6,582,491 | B2 | 6/2003 | Hoffman et al. |
| 6,592,649 | B2 | 7/2003 | Kikuchi et al. |
| 6,755,888 | B2 | 6/2004 | Ibaraki et al. |
| 8,262,766 | B2 | 9/2012 | Sugitatsu et al. |
| 2002/0033075 | A1 | 3/2002 | Ito et al. |
| 2003/0013055 | A1 | 1/2003 | Wenghoefer et al. |
| 2003/0097908 | A1 | 5/2003 | Hoffman et al. |
| 2006/0096420 | A1 | 5/2006 | Sugitatsu et al. |

(Continued)

FOREIGN PATENT DOCUMENTS

WO 2013011521 A1 1/2013

OTHER PUBLICATIONS

Jun. 12, 2014 International Search Report issued in International Patent Application No. PCT/US2014/021216.

*Primary Examiner* — Jessee Roe
*Assistant Examiner* — Jenny Wu
(74) *Attorney, Agent, or Firm* — Clements Bernard PLLC; Christopher L. Bernard; Lawrence A. Baratta, Jr.

(57) ABSTRACT

A method for reducing a chromium containing material, comprising: combining the chromium containing material comprising chromium oxide with a carbonaceous reductant to form a chromium containing mixture; delivering the chromium containing mixture to a moving hearth furnace and reducing the chromium containing mixture to form a reduced chromium containing mixture; delivering the reduced chromium containing mixture to a smelting furnace; and separating the reduced chromium containing mixture into chromium metal and slag. The method also comprises agglomerating the chromium containing mixture in a granulator or the like. The chromium containing mixture has an average particle size of less than about 200 mesh (about 75 μm).

15 Claims, 6 Drawing Sheets

(56) References Cited

U.S. PATENT DOCUMENTS

| | | | |
|---|---|---|---|
| 2009/0183600 | A1 | 7/2009 | Kikuchi et al. |
| 2010/0300247 | A1 | 12/2010 | Harada et al. |
| 2012/0219808 | A1 | 8/2012 | Raybould et al. |

4

METHODS AND SYSTEMS FOR REDUCING CHROMIUM CONTAINING RAW MATERIAL

CROSS-REFERENCE TO RELATED APPLICATION(S)

The present patent application/patent claims the benefit of priority of U.S. Provisional Patent Application No. 61/773,502, filed on Mar. 6, 2013, and entitled "METHOD AND SYSTEMS FOR REDUCING CHROMIUM CONTAINING RAW MATERIAL," the contents of which are incorporated in full by reference herein.

FIELD OF THE INVENTION

The present invention relates generally to ferrochromium manufacturing technology and improved methods and systems for reducing chromium containing raw material.

BACKGROUND OF THE INVENTION

Conventionally, high-carbon ferrochromium is manufactured by smelting and reducing chromium ore after pretreatment in a submerged electric arc furnace (EAF) or the like. Examples of the pretreatment of the chromium ore include briquetting, sintering, pellet firing, and pellet pre-reduction.

In pellet pre-reduction, for example, the chromium ore is pulverized with coke and is granulated to prepare green pellets, which are then subjected to reduction roasting in a rotary kiln or the like at about 1,300 degrees C. or higher to provide pre-reduced pellets. The reduction degree of these pre-reduced pellets, which is 60% to 70% with only internally added coke, reaches 80% in combination with externally added coke. This method, therefore, has a significantly smaller amount of heat required for the reduction of chromium ore in the EAF than other types of pretreatment, thus greatly reducing power consumption.

Pellet pre-reduction is an advantageous method with low power consumption; however, this method, involving the use of a rotary kiln for the pretreatment, has the following problems unique to the rotary kiln. Because the fundamental principle of the rotary kiln is based on the tumbling of feedstock, the rotary kiln disadvantageously produces a large amount of dust that readily causes dam rings therein. In addition, the rotary kiln requires an excessive length due to variations in the residence time of the feedstock, thus involving a large equipment installation area and a large surface area. Consequently, the rotary kiln disadvantageously dissipates a large amount of heat, leading to higher fuel consumption than is desirable. Furthermore, a combination with externally added coke is disadvantageous in that it causes a large oxidation loss of the externally added coke in the rotary kiln.

Chromium oxide is reduced less easily than iron oxide from a thermodynamic perspective. The temperature of the pellets in the kiln is gradually raised by heating the pellets with a burner provided on a discharge end of the kiln. Accordingly, the internally added coke is consumed preferentially in the reduction of iron oxide contained in the chromium ore since iron oxide is reduced more easily than chromium oxide. As a result, the reduction of chromium oxide lags behind since chromium oxide is reduced less easily than iron oxide.

To solve these problems unique to rotary kilns, methods have been proposed in which a rotary hearth furnace (RHF) is used for the pre-reduction.

In one such method, green pellets, prepared by adding a carbonaceous material to a steel mill waste containing Cr and Fe and granulating the mixture, are preheated to about 600 degrees C. to 800 degrees C. with a shaft pre-heater, and are then charged into a rotary hearth furnace and gradually heated to about 1,000 degrees C. to 1,800 degrees C. in a reducing atmosphere.

In another such method, green pellets, prepared by adding a proper amount of chromium ore to a chromium-containing waste produced in the manufacturing process of stainless steel and granulating the mixture with coke, are placed on a hearth of a rotary hearth furnace and heated with a combustion gas to manufacture pellets containing chromium and iron.

The above methods, in contrast to rotary kilns, produce less dust and, therefore, cause no dam rings because the feedstock placed on the rotary hearth is stationary. In addition, no excessive hearth area is required since the residence time of the feedstock is uniform. Accordingly, the equipment used is more compact and the furnace surface area is smaller, such that the furnace has less dissipated heat and provides lower fuel consumption.

In the above methods, however, the internally added carbonaceous material starts to reduce iron oxide even at about 600 degrees C. to 800 degrees C. in the shaft preheater (while the carbonaceous material does not reduce chromium oxide at such temperatures). In addition, the pellets are gradually heated in the rotary hearth furnace; as a result, the carbonaceous material is consumed preferentially in the reduction of iron oxide. By the time the furnace reaches the temperature at which the reduction of chromium oxide can start, the chromium oxide loses the opportunity to come into contact with the carbonaceous material for lack of the carbonaceous material to give a low chromium reduction degree. On the other hand, increasing the amount of carbonaceous material added internally to maintain the contact opportunity causes the following typical problems: the green pellets disintegrate due to a decrease in strength to form deposits on the hearth; the dust loss from the rotary hearth furnace to the flue gas is increased; and the reduced pellets disintegrate, or otherwise their density decreases, to cause difficulty in dissolving in molten metal in the electric furnace, leading to a lower smelting yield.

Furthermore, the above methods make no mention of the heating temperature and temperature raising rate of the pellets and the above problem that the reduction of chromium oxide lags behind.

Accordingly, an object of U.S. Pat. No. 8,262,766 (Sugitatsu et al.), which forms a conceptual basis for some of the improvements of the present invention, for example, is to provide methods and systems for reducing a chromium containing raw material. When a chromium containing raw material that contains chromium oxide and iron oxide and is provided with an internally added carbonaceous material is reduced (i.e. pre-reduced), these methods and systems promote the reduction of chromium oxide, while suppressing the preferential consumption of the internally added carbonaceous material in the reduction of the iron oxide, thereby increasing the chromium reduction degree. However, these methods and systems also suffer from significant shortcomings, which are addressed by the methods and systems of the present invention, as described herein below.

BRIEF SUMMARY OF THE INVENTION

Again, U.S. Pat. No. 8,262,766 provides methods and systems for reducing a chromium containing raw material, including a mixing step of mixing a chromium containing raw material containing chromium oxide and iron oxide and a carbonaceous reductant to provide a mixture; and a reducing step of heating and reducing the mixture with a rapid temperature rise by radiation heating in a moving hearth furnace to provide a reduced mixture.

If the temperature of the mixture is rapidly raised in the moving hearth furnace, the reduction of chromium oxide can be allowed to start before the internally added carbonaceous material in the mixture is consumed in the reduction of iron oxide. Accordingly, the reduction of chromium oxide proceeds while the contact opportunity between chromium oxide and the internally added carbonaceous material is maintained. This method can, therefore, provide a reduced mixture having a high chromium reduction degree. In particular, a moving hearth furnace in which a feedstock placed on the hearth is stationary is preferably used for the heating and reduction of the mixture. The use of such a furnace can significantly reduce the amount of dust produced and prevent dam rings due to dust deposited on the furnace walls. In addition, this furnace does not require extensive equipment as required for rotary kilns since the residence time of the mixture is uniform in the furnace. Accordingly, the equipment used is more compact and therefore provides the advantages of a smaller installation area and a less amount of heat dissipated.

In this implementation, the average rate of raising the temperature of the mixture in the reducing step is preferably 13.6 degrees C./s or higher in the period from the initiation of the radiation heating of the mixture until the mixture reaches about 1,114 degrees C. A rapid temperature rise at this temperature raising rate provides the above effects more reliably. In this implementation, the reducing step is preferably performed at about 1,250 degrees C. to 1,400 degrees C. The reducing step in the moving hearth furnace at such a temperature allows efficient reduction of chromium oxide.

This implementation preferably further includes a reducing and melting step of melting the reduced mixture provided in the reducing step by successive radiation heating to provide a reduced molten material. The melting after the reduction causes the aggregation of metal and/or slag to reduce the surface area of the metal and/or slag and the area of the interface between the metal and slag, thereby reducing undesirable reactions, such as reoxidation. In addition, the melting following the reduction in the same furnace can avoid a temperature drop that occurs when, for example, the reduced mixture is discharged from the moving hearth furnace after the reduction and is transferred and melted in another apparatus. This method can therefore suppress energy loss in the melting of the reduced mixture.

This implementation preferably further includes a solidifying step of cooling and solidifying the reduced molten material provided by radiation heating in the moving hearth furnace to provide a reduced solid; and a separating step of separating the reduced solid into metal and slag. Accordingly, the mixture is reduced and molten in the moving hearth furnace, in which the feedstock placed on the hearth is stationary, to remove slag and recover metal from the mixture. This method therefore requires no smelting furnace, thus significantly reducing equipment cost and energy consumption. In this implementation, the melting step by radiation heating is preferably performed at a temperature higher than that in the reducing step within the range of about 1,350 degrees C. to 1,700 degrees C. The chromium content of the reduced mixture can be recovered as metal chromium contained in the metal, rather than removed as chromium oxide contained in the slag by allowing the reduction of chromium oxide contained in the reduced mixture to proceed sufficiently at about 1,250 degrees C. to 1,400 degrees C. before melting the reduced mixture at about 1,350 degrees C. to 1,700 degrees C. This method can therefore provide a high yield of chromium.

In this implementation, a carbonaceous atmosphere-adjusting agent is preferably charged together with the mixture onto the hearth of the moving hearth furnace in the reducing step. If the carbonaceous atmosphere-adjusting agent is charged together with the mixture onto the hearth, volatile components de-volatilized from the atmosphere-adjusting agent and gases such as CO and $H_2$ produced in the solution loss reaction of $CO_2$ and $H_2O$ contained in the atmosphere gas keep the vicinity of the mixture in a reducing atmosphere to prevent the re-oxidation of the reduced mixture. The volatile components and the gases, such as CO and $H_2$, can also be used as fuels for the radiation heating in the moving hearth furnace to reduce the fuel consumption in the moving hearth furnace. In addition, the atmosphere-adjusting agent is converted into a carbon-based material that does not soften at high temperature after the de-volatilization. This material can prevent the buildup of deposits on the hearth to reduce the load on a discharger that discharges the reduced mixture (or the reduced molten material or reduced solid) and the abrasion of members such as cutting edges. Furthermore, the carbon-based material discharged together with the reduced mixture (or the reduced molten material or reduced solid) can be used as a reductant and/or heat source in the following smelting step.

However, in various exemplary embodiments, the present invention provides numerous improvements to this implementation. First, with regard to the agglomerates utilized, the agglomerates may be pellets, briquettes, or extrusions and the particle size is fundamentally important. The ore and the coal must be finely ground, with less than about 200 mesh (about 75 μm) size, for example. Low density and internal porosity are also fundamentally important, and can be provided by utilizing internal melting substances, such as paper fluff, Polystyrene/Styrofoam beads, or the like. It has been found that extruded hollows or the like with high aspect ratios are most advantageous, for both chromium ores and iron ores. The idea is to make extrusions with one or several holes (axially, for example) to facilitate heat transfer and gas evolution out of the extrusions. The use of binders, such as Bentonite, molasses, or the like; slag formers, such as Si for DRC strength, the formation of fayerlite $FeSiO_4$, and the like; and fluxes, such as $CaF_2$, NaOH, or the like, are all advantageous. Finally, the use of a protective layer on the agglomerates is important, such as providing a hard surface on the briquettes, or a coating before drying. This helps to prevent re-oxidation while allowing CO gas to escape, especially where the drying of a coating generates cracks that provide preferred escape routes for the CO gas.

Second, with regard to the RHF, a higher operating temperature is desirable (about 1,450 degrees C. to 1,500 degrees C., for example). Further, an electric are or induction furnace (EIF) may be used as a melter for the ferrochrome, extending its conventional use with Fe alone. There may be a direct charge to the melter, using sensible heat. Off-gas from the melter may be used as a reducing atmosphere in the RHF, thereby providing additional reductant. Hearth powder (coal, optionally pre-heated) may be used to prevent re-oxidation, and oxidation in a first short zone may be used to create a protective passive layer, as well as passing reducing gas in later zones, with an RX generator or mini-Midrex reformer. Natural gas may be injected in the cooling zone, depositing C and providing a reducing atmosphere, such that re-oxidation is prevented during cooling. Preferably, natural gas is reformed to CO right at the pellets, and C is provided from the natural gas. In other words, natural gas should be injected as close as possible to the hearth. Different liquids may be used for the water seal, preventing oxidizing conditions, such as Propylene Glycol. Paraffin, Dowtherm, or the like. These are stable, with no steam and no burn. Natural gas may be injected above the water seal to cause a reforming reaction, to transform a bad oxidizer to a good reductant (as the gas mixture gets hot $CH_4+H_2O=CO+3H_2$).

Third, post-RHF operation, grinding and separation of the chrome metal may be accomplished via magnetic separation or density differences. In fact, using the methods and systems of the present invention, ferrochrome is present in the RHF and a melter may not be needed given these separation technologies, with agglomeration in briquettes.

Each of these novel and important extensions is described in further detail herein below.

In one exemplary embodiment, the present invention provides a method for reducing a chromium containing material, comprising: combining the chromium containing material comprising chromium oxide with a carbonaceous reductant to form a chromium containing mixture; delivering the chromium containing mixture to a moving hearth furnace and reducing the chromium containing mixture to form a reduced chromium containing mixture; delivering the reduced chromium containing mixture to a smelting furnace; and separating the reduced chromium containing mixture into chromium metal and slag. The method also comprises agglomerating the chromium containing mixture in a granulator. Optionally, the method further comprises providing a carbonaceous atmosphere-adjusting agent on or proximate the chromium containing mixture. Optionally, the method still further comprises providing a hearth-protecting material on or proximate the chromium containing mixture. The chromium containing mixture has an average particle size of less than about 200 mesh (about 75 μm). Optionally, the method still further comprises combining the chromium containing mixture with an internal melting substance to increase the internal porosity and decrease the density thereof. Optionally, the method still further comprises forming the chromium containing mixture into extruded hollows of elongate shape. Optionally, the method still further comprises adding a binder to the chromium containing mixture. Optionally, the agglomerated chromium containing mixture comprises a barrier coating. Optionally, the smelting furnace comprises an electric arc or induction furnace. Optionally, the method still further comprises recycling off-gas from the smelting furnace to the moving hearth furnace as reducing gas. Optionally, the method still further comprises adding hearth powder to the chromium containing mixture. Optionally, the method still further comprises oxidizing the chromium containing mixture in a first short zone of the moving hearth furnace to create a protective passive layer thereon. Optionally, the method still further comprises injecting natural gas into a cooling zone of the moving hearth furnace to prevent re-oxidation of the reduced chromium containing mixture during cooling. Optionally, the method still further comprises utilizing a sealing liquid in the moving hearth furnace that prevents oxidizing conditions therein. Optionally, the method still further comprises injecting natural gas proximate the sealing liquid to cause a reforming reaction to transform a bad oxidizer to a good reductant. Optionally, the method still further comprises extracting chrome metal from the reduced chromium containing mixture using one or more of magnetic separation and density difference separation.

BRIEF DESCRIPTION OF THE DRAWINGS

The present invention is illustrated and described herein with reference to the various drawings, in which like reference numbers are used to denote like method steps/system components, as appropriate, and in which.

DETAILED DESCRIPTION OF THE INVENTION

Figure 1:
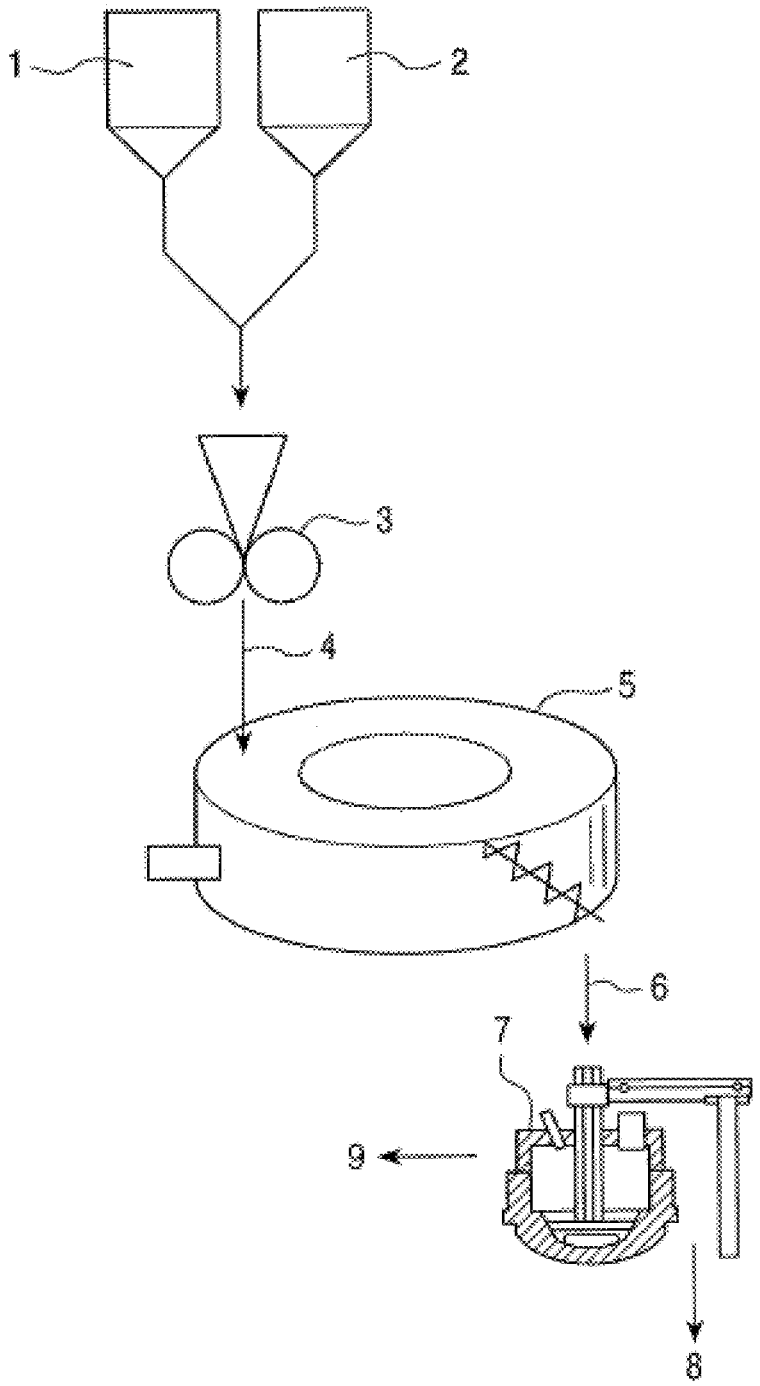
FIG. 1 (Prior Art)
FIG. 1 is a schematic diagram including a step of reducing a chromium-containing material according to U.S. Pat. No. 8,262,766.

FIG. 1 is a schematic diagram including a step of reducing a chromium-containing material according to U.S. Pat. No. 8,262,766. Reference numeral 1 indicates a storage container for a chromium-containing material containing chromium oxide and iron oxide (or the chromium-containing material); reference numeral 2 indicates a storage container for a carbonaceous reductant; reference numeral 3 indicates a granulator; reference numeral 4 indicates a charging path for a mixture (agglomerates) fed from the granulator 3; reference numeral 5 indicates a moving hearth furnace; reference numeral 6 indicates a transfer path for a reduced mixture (preferably, in the form of agglomerates); reference numeral 7 indicates a smelting furnace; reference numeral 8 indicates a path for recovered metal; and reference numeral 9 indicates a path for removed slag.

The chromium-containing material 1 used may be chromium ore or residues produced in the manufacturing process of ferrochromium, including dust and slag produced at ferrochromium manufacturing plants. The components of the chromium-containing material 1 used may be optionally adjusted by adding iron ore or mill scale. The moving hearth furnace 5, in which a feedstock is stationary on the hearth, is used instead of a rotary kiln, so that no dam ring occurs. In addition, the slag content of the chromium-containing material 1 used is not limited; therefore, the material used may be freely selected. The chromium-containing material 1, if having a high water content, is preferably dried in advance. The degree of drying may be determined in consideration of mixing means in the following mixing step (the granulator 3 in this embodiment). The carbonaceous reductant 2 used may be any material that contains fixed carbon. Examples of such a material include coal, coke, charcoal, waste toner, carbides of biomass, and their mixtures.

The chromium-containing material 1 and the carbonaceous reductant 2 preferably have a smaller particle size to attain a larger number of contact opportunities in view of the reduction reaction. Excessively small particles, however, are difficult to granulate. Thus, preferably, about 70% of the particles of the chromium-containing material 1 and the carbonaceous reductant 2 have a particle size not more than about 200 mesh (about 75 μm). These materials are therefore preferably pulverized in advance according to need.

In this implementation, a feedstock mixture 4 (preferably, in the form of agglomerates), provided by mixing the chromium-containing material 1 and the carbonaceous reductant 2, is charged into the moving hearth furnace 5. The mixing ratio of the carbonaceous material 2 in this mixture may be determined according to the amount of carbon required to reduce chromium oxide and iron oxide contained in the mixture in the moving hearth furnace 5; the amount of carbon consumed in, for example, the reduction of residual chromium oxide in the reduced mixture (or a reduced mixture or reduced solid) in the smelting furnace 7; and a target amount of carbon remaining in metal (reduced metals such as reduced iron and reduced chromium) recovered from the smelting furnace 7. To increase the chromium reduction degree, it is important that the feedstock mixture 4 contain a larger amount of carbon than a theoretical amount of carbon required, which is described later, in consideration that the reduction of chromium oxide is a solid-phase reaction.

The chromium-containing material 1 and the carbonaceous reductant 2 are preferably homogeneously mixed with a mixer (not illustrated). The resultant mixture 4, which may be charged directly into the moving hearth furnace 5, is preferably agglomerated with the granulator 3. The agglomeration can reduce the amount of dust produced from the moving hearth furnace 5 and smelting furnace 7 and improve the heat transfer efficiency inside the feedstock mixture 4 (agglomerates; "feedstock mixture" hereinafter refers to agglomerated feedstock mixture) in the moving hearth furnace 5 to raise the reduction degree. In the agglomeration, an auxiliary material, such as a flux, may be added to the feedstock mixture. The granulator 3 used may be, for example, a compression molding machine such as a briquetting press, a tumbling granulator, such as a disc pelletizer, or an extruder. The granulated feedstock mixture, if having a high water content, may be dried before the charge into the moving hearth furnace 5.

The granulated feedstock mixture 4 is charged into the moving hearth furnace 5 and is heated by radiation heating. The moving hearth furnace 5 used may be a rotary hearth furnace (RHF), a straight furnace, or a multiple hearth furnace. The radiation heating may be conducted with, for example, a burner.

The feedstock mixture charged into the furnace is heated by radiation heating, allowing fixed carbon contained in the carbonaceous reductant 2 to reduce iron oxide and chromium oxide in the mixture according to the following main reaction formulas (1) and (2):

$$FeO+C \rightarrow Fe+CO-36.8\ \text{kcal}$$

$$\Delta G^{0}35{,}350-35.9T \quad (1)$$

$$7Cr_2O_3+27C \rightarrow 2Cr_7C_3+21CO-1{,}250.6\ \text{kcal}$$

$$\Delta G^{0}=1{,}230{,}132-886.97T \quad (2)$$

The reaction of the formula (1) starts at about 712 degrees C., while the reaction of the formula (2) starts at about 1,114 degrees C. Part of the Fe reduced in the formula (1) dissolves in $Cr_7C_3$ produced in the formula (2) to form $(Cr.Fe)_7C_3$.

The average rate of raising the temperature of the feedstock mixture is preferably 13.6 degrees C./s or higher in the period from the initiation of the radiation heating of the feedstock mixture until the feedstock mixture reaches about 1,114 degrees C., namely the temperature at which the reduction of chromium oxide starts.

The initiation of the radiation heating of the feedstock mixture 4 herein refers to the point in time when the feedstock mixture 4 enters a region (radiation heating region) exposed to radiation heating with, for example, a burner in the moving hearth furnace 5. The above period does not include the period from the charge of the mixture 4 onto the hearth until the mixture enters the radiation heating region for the following reason. In the period from the charge of the feedstock mixture 4 onto the hearth until the mixture enters the radiation heating region, the feedstock mixture 4 is mainly heated only with heat transferred from the hearth. In addition, this period (passage time) is normally short. Accordingly, the feedstock mixture 4 does not reach 712 degrees C. namely the temperature at which the reduction of FeO starts. The fixed carbon content of the internally mixed carbonaceous reductant 2 is therefore not substantially consumed by the reduction of FeO.

The temperature in the radiation heating region (in the reducing step) is preferably about 1,250 degrees C. to 1,600 degrees C. At temperatures below 1,250 degrees C., the rate of raising the temperature of the feedstock mixture to 1,114 degrees C. is often insufficient. At temperatures above 1,600 degrees C., on the other hand, a reduced mixture (reduced agglomerates) provided by reducing the feedstock mixture 4 is softened to aggregate or adhere to the hearth.

When, for example, the temperature in the radiation heating region (in the reducing step) is 1,300 degrees C., the residence time of the mixture 4 in the radiation heating region is preferably 5.3 to 42.7 minutes.

A reducing atmosphere is preferably kept in the radiation heating region (in the reducing step) by adjusting the air ratio of the burner or by blowing a reducing gas into the moving hearth furnace 5 to prevent the reoxidation of Fe and $Cr_7C_3$ produced by the reduction.

The reduced mixture provided by reducing the feedstock mixture 4 in the moving hearth furnace 5 is normally cooled to about 1,000 degrees C. with, for example, a radiant cooling plate or a refrigerant spraying machine provided in the moving hearth furnace 5. After the cooling, the reduced mixture 6 is discharged with a discharger.

The above theoretical amount of carbon required refers to the amount of carbon required theoretically for producing $(Cr.Fe)_7C_3$ from iron oxide and chromium oxide contained in the feedstock mixture 4 through the reactions of the above formulas (1) and (2). This theoretical amount is defined by the following equation: theoretical amount of carbon required (mol)=(number of moles of $Cr_2O_3$)×27/7+(number of moles of O combined with Fe)+(number of moles of Fe)×3/7. In the above reducing step, it is recommended that a carbonaceous atmosphere-adjusting agent be charged together with the feedstock mixture 4 onto the hearth in the moving hearth furnace 5. The hearth is particularly preferably covered with the atmosphere-adjusting agent before the charge of the feedstock mixture 4, though a certain effect can be provided by charging the atmosphere-adjusting agent together with the feedstock mixture 4 or after the charge of the feedstock mixture 4.

As described above, the charge of the carbonaceous atmosphere-adjusting agent has the following typical effects: (1) the agent keeps the vicinity of the feedstock mixture 4 in a reducing atmosphere to prevent the reoxidation of the reduced mixture; (2) volatile components produced from the agent and gases such as CO can be used as fuels for the moving hearth furnace 5 to reduce the fuel consumption in the moving hearth furnace 5; (3) the agent prevents the buildup of deposits on the hearth to reduce the load on the discharger and the abrasion of members such as cutting edges; and (4) the agent discharged together with the reduced mixture after the devolatilization can be used as a reductant and/or heat source in the following smelting step.

The carbonaceous atmosphere-adjusting agent used is preferably coal, waste plastics, waste tires, or biomass. If, for example, coal or biomass is used, it is charred in the moving hearth furnace 5. The volatile components can be used as a fuel in the moving hearth furnace 5 while the charred components can be used as a reductant and/or heat source in the smelting furnace. Other examples of the material used include coke, charcoal, petroleum coke, and char. These materials, containing a less amount of volatile components, have a less effect of reducing the fuel consumption in the moving hearth furnace 5 than the above materials such as coal.

In this implementation, the size (particle diameter) of the atmosphere-adjusting agent is not particularly limited, though it is recommended that the size be 5 mm or smaller on average, more preferably 2 mm or smaller on average. The thickness of the atmosphere-adjusting agent fed onto the hearth is preferably about 1 to 50 mm.

In addition to the atmosphere-adjusting agent, a hearth-protecting material may be fed to prevent the buildup of deposits on the hearth. Then the atmosphere-adjusting agent is preferably charged onto the hearth-protecting material. The hearth-protecting material preferably contains a material having a high melting point and, more preferably, further contains a carbonaceous material. An oxide containing alumina and/or magnesia or a material containing silicon carbide is recommended as the material having a high melting point.

The hot reduced mixture discharged from the moving hearth furnace 5 is preferably charged into the smelting furnace 7 without further cooling. The smelting furnace 7 may be directly connected to an outlet of the moving hearth furnace 5 through, for example, a chute. Alternatively, the reduced mixture may be charged into the smelting furnace 7 using transport equipment such as a conveyor or after temporary storage in, for example, a container. If the moving hearth furnace 5 and the smelting furnace 7 are not near to each other or the operation of the smelting furnace 7 is stopped, the reduced mixture 6 may be cooled to room temperature to provide a semi-finished product (a feedstock for refined ferrochromium) for storage and transport before use. Alternatively, the hot reduced mixture is also preferably subjected to hot briquetting to reduce its surface area before cooling to provide a semi-finished product having good reoxidation resistance for storage and transport before use. The smelting furnace 7 used may be an electric furnace or a smelting furnace utilizing a fossil energy such as coal, heavy oil, and natural gases. A flux, for example, is charged into the smelting furnace 7 according to need. The reduced mixture is smelted at a high temperature of about 1,400 degrees C. to 1,700 degrees C. to separate the mixture into metal and slag. The metal is used as charge chromium or is optionally subjected to secondary refining to produce ferrochromium.

Figure 2:
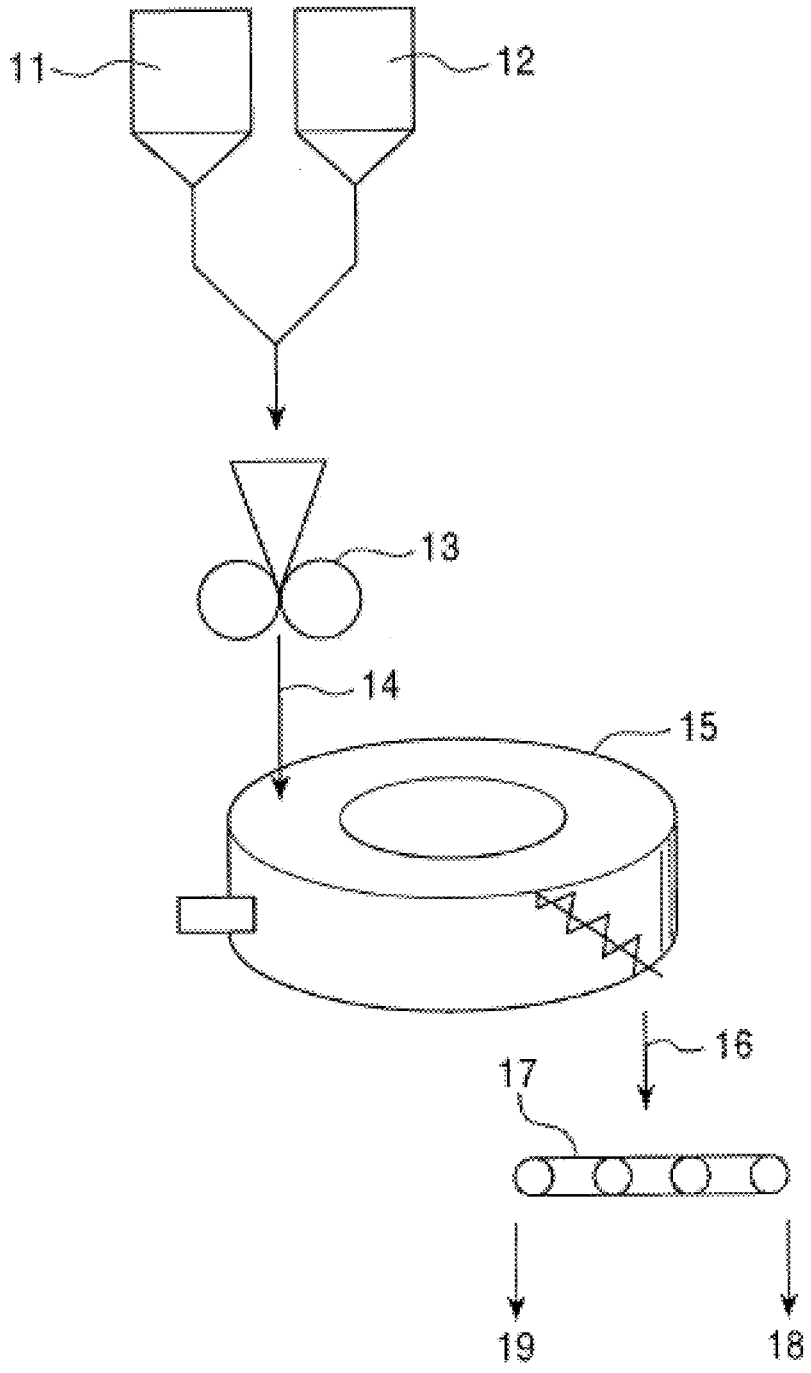
FIG. 2 (Prior Art)
FIG. 2 is a schematic diagram including another step of reducing a chromium-containing material according to U.S. Pat. No. 8,262,766.
Figure 3:
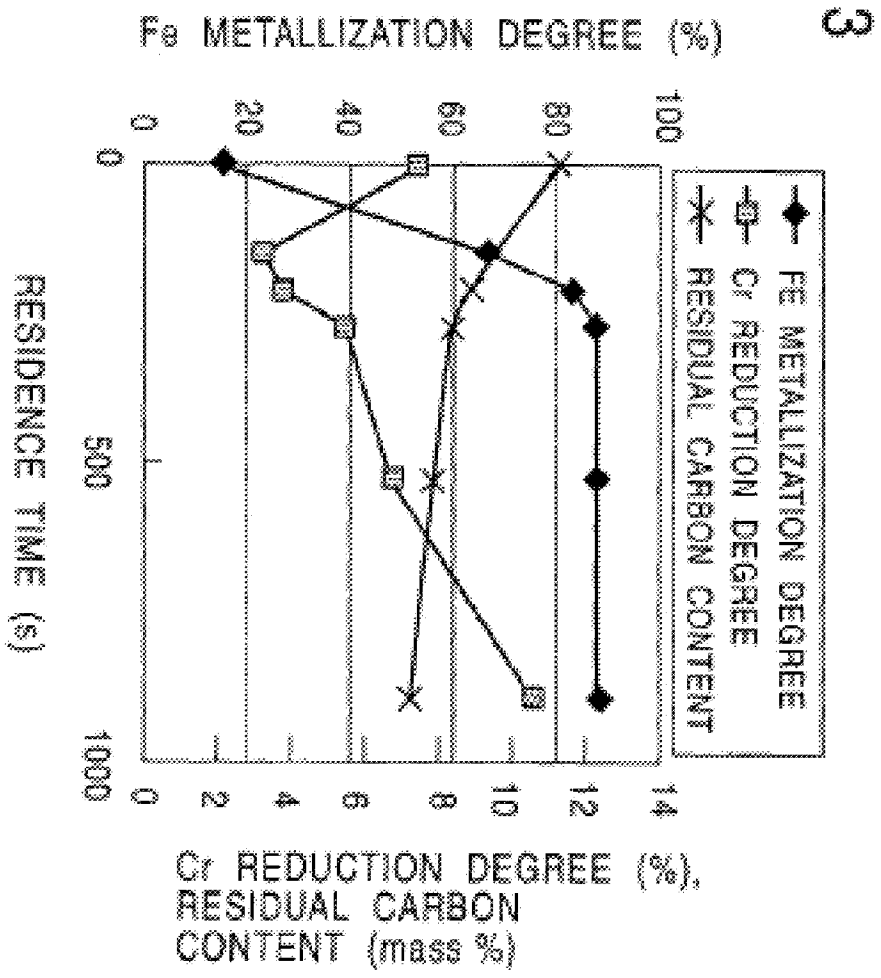
FIG. 3 (Prior Art)
FIG. 3 is a graph showing the relationship between residence time and Cr reduction degree, Fe metallization degree, and residual carbon content at about 1,200 degrees C.
Figure 4:
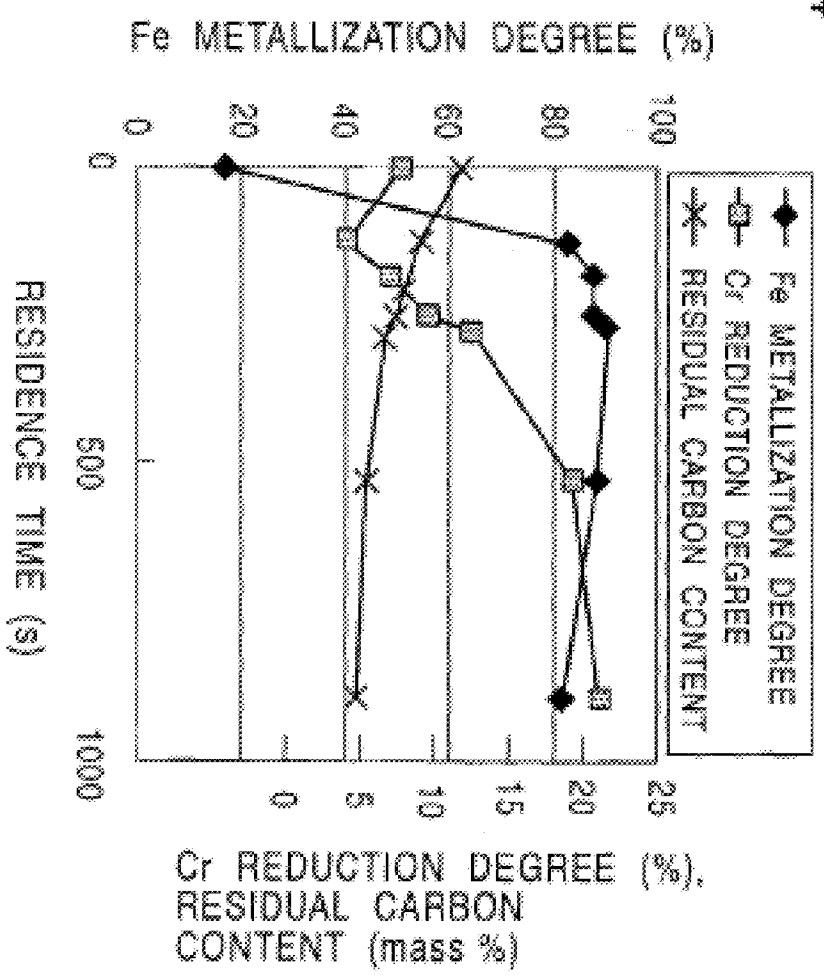
FIG. 4 (Prior Art)
FIG. 4 is a graph showing the relationship between the residence time and the Cr reduction degree, the Fe metallization degree, and the residual carbon content at about 1,300 degrees C.

FIG. 2 is a flow chart including another step of reducing a chromium-containing material according to U.S. Pat. No. 8,262,766. In FIG. 2, reference numeral 11 indicates a storage container for a chromium-containing material containing chromium oxide and iron oxide; reference numeral 12 indicates a storage container for a carbonaceous reductant; reference numeral 13 indicates a granulator; reference numeral 14 indicates a path for a mixture (agglomerates); reference numeral 15 indicates a moving hearth furnace; reference numeral 16 indicates a path for a recovered reduced solid; reference numeral 17 indicates a screen; reference numeral 18 indicates a metal path (or metal); and reference numeral 19 indicates a slag path (or slag). The chromium-containing material 11, the carbonaceous reductant 12, the granulator 13, the feedstock mixture 14 (agglomerates), the moving hearth furnace 15, and the mixing step in the second embodiment are the same as those in the first embodiment; therefore, they are not described herein.

The granulated feedstock mixture 14 (agglomerates) is charged into the moving hearth furnace 15 and is heated to about 1,250 degrees C. to 1,400 degrees C. by radiation heating. The average rate of raising the temperature of the feedstock mixture by radiation heating, as in the first embodiment described above, is preferably 13.6 degrees C./s or higher in the period from the initiation of the radiation heating of the mixture until the mixture reaches 1,114 degrees C. In addition, the residence time of the feedstock mixture 14 in the radiation heating region is preferably 5.3 to 42.7 minutes.

After the reduction, the resultant reduced mixture (agglomerates) is successively heated and melted to produce a reduced molten material in the moving hearth furnace 15 at a temperature higher than that in the above reduction region (1,250 degrees C. to 1,400 degrees C.), for example 1,350 degrees C. to 1,700 degrees C., preferably 1,350 degrees C. to 1,650 degrees C., more preferably 1,350 degrees C. to 1,600 degrees C. The heating and melting temperature has a lower limit of 1,350 degrees C. because the reduced mixture is difficult to melt at temperatures below 1,350 degrees C. On the other hand, the heating and melting temperature has an upper limit of 1,700 degrees C. because any problem associated with the heat resistance of the reducing furnace readily occurs at temperatures above 1,700 degrees C. The residence time of the reduced mixture in this temperature range is preferably 0.5 to 10 minutes. Within this residence time, the reduced mixture can be sufficiently molten to separate into metal and slag. The residence time of the reduced mixture has a lower limit of 0.5 minutes because the separation into metal and slag is often insufficient within a residence time shorter than 0.5 minutes. On the other hand, the residence time of the reduced mixture has an upper limit of 10 minutes because the separation into metal and slag reaches a saturation level and re-oxidation is more likely to occur for a residence time longer than 10 minutes.

In this embodiment, the feedstock mixture 14 is heated in the moving hearth furnace 15 in two temperature steps. In the present invention, the feedstock mixture 14 may also be heated at 1,350 degrees C. to 1,700 degrees C. from the start (in one temperature step) so that the reduction and melting can proceed concurrently to provide the reduced molten material in a shorter time.

Both metal and slag do not necessarily need to be molten. As long as both can be separated, one of them may be unmelted. The atmosphere-adjusting agent and hearth-protecting material used are the same as those in the first embodiment. The reduced molten material is solidified by cooling it to about 1,000 degrees C. in the moving hearth furnace 15 to produce a reduced solid. Examples of the cooling and solidifying means used in the moving hearth furnace 15 include the radiant cooling plate and refrigerant spraying machine described above in the first embodiment.

The reduced solid 16 may be further cooled after the discharge from the moving hearth furnace 15 by cooling and solidifying means such as water granulation, indirect water cooling, and refrigerant spraying.

The reduced solid 16 is disintegrated according to need and is separated through a screen 17 into metal 18 (crude ferrochromium) and slag 19. The metal content of the separated slag 19 may be optionally recovered by means such as magnetic separation and flotation. The separated metal 18 (crude ferrochromium) 18 optionally subjected to secondary refining to produce a ferrochromium product. Alternatively, the metal 18 (crude ferrochromium) may be used as a semi-finished product (a feedstock for refined ferrochromium) to be smelted in a smelting furnace. In the method of the first embodiment, the semi-finished product, namely the reduced agglomerates, contains residual slag. In the method of the second embodiment, on the other hand, the slag content has been removed from the semi-finished product, namely the metal 18, so that the smelting furnace requires no smelting energy for removing the slag content. The method of the second embodiment can therefore greatly reduce the energy consumption of the smelting furnace. In addition, this method can significantly reduce the amount of slag produced in the smelting furnace to greatly improve the production efficiency of the smelting furnace. The metal 18 (crude ferrochromium) may be used as a feedstock for ferrochromium, or may be directly used as a feed stock for manufacturing chromium-containing alloys. This implementation at production sites of chromium ore since the weight of the semi-finished product can be reduced by the slag content to cut down its storage and transport costs. In addition, the metal (crude ferrochromium) 18 may be optionally agglomerated for convenience in storage and transport.

The atmosphere-adjusting agent used may be recovered for recycling, or may be charged together with the metal into the smelting furnace. In addition, the hearth-protecting material used is preferably recovered for recycling.

The present invention provides numerous improvements to this implementation. First, with regard to the agglomerates utilized, the agglomerates may be pellets, briquettes, or extrusions and the particle size is fundamentally important. The ore and the coal must be finely ground, with less than about 200 mesh (about 75 μm) size, for example. Low density and internal porosity are fundamentally important, and can be provided by utilizing internal melting substances, such as paper fluff, Polystyrene/Styrofoam beads, or the like. It has been found that extruded hollows or the like with high aspect ratios are most advantageous, for both chromium ores and iron ores. The idea is to make extrusions with one or several holes (axially, for example) to facilitate heat transfer and gas evolution out of the extrusions. The use of binders, such as Bentonite, molasses, or the like; slag formers, such as Si for DRC strength, the formation of fayerlite $FeSiO_4$, and the like; and fluxes, such as $CaF_2$, NaOH, or the like, are all advantageous. Finally, the use of a protective layer on the agglomerates is important, such as providing a hard surface on the briquettes, or a coating before drying. This helps to prevent re-oxidation while allowing CO gas to escape, especially where the drying of a coating generates cracks that provide preferred escape routes for the CO gas.

Figure 5:
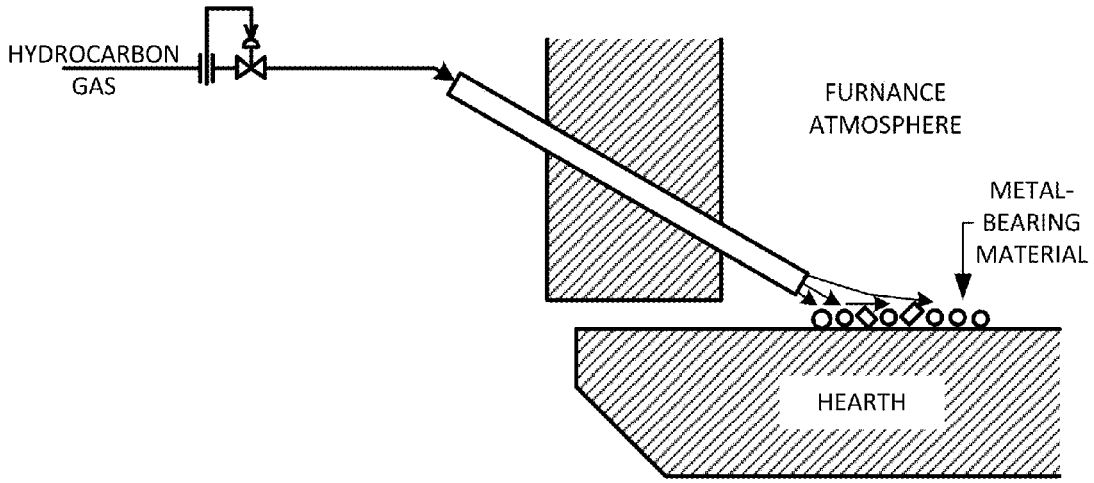
FIG. 5 is a schematic diagram illustrating one exemplary embodiment of a method and system for decreasing the de-carburization and oxidation of metallic pellets in accordance with the present invention.
Figure 6:
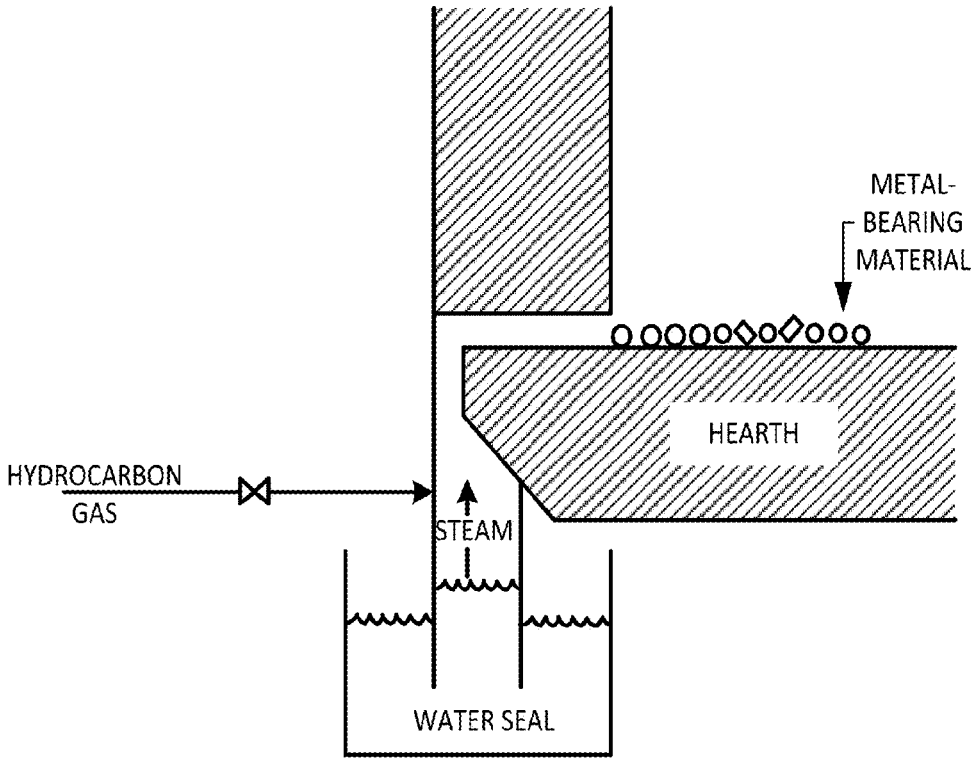
FIG. 6 is a schematic diagram illustrating one exemplary embodiment of a method and system for decreasing the oxidation of metallic pellets involving the water seal utilized in accordance with the present invention.

Second, with regard to the RHF, a higher operating temperature is desirable (about 1,450 degrees C. to 1,500 degrees C., for example). Further, an EIF may be used as a melter for the ferrochrome, extending its conventional use with Fe alone. There may be a direct charge to the melter, using sensible heat. Off-gas from the melter may be used as a reducing atmosphere in the RHF, thereby providing additional reductant. Hearth powder (coal, optionally preheated) may be used to prevent re-oxidation, and oxidation in a first short zone may be used to create a protective passive layer, as well as passing reducing gas in later zones, with an RX generator or mini-Midrex reformer. Natural gas may be injected in the cooling zone, depositing C and providing a reducing atmosphere, such that re-oxidation is prevented during cooling. Preferably, natural gas is reformed to CO right at the pellets, and C is provided from the natural gas, as is illustrated in FIG. 5. In other words, natural gas should be injected as close as possible to the hearth. Different liquids may be used for the water seal, preventing oxidizing conditions, such as Propylene Glycol, Paraffin, Dowtherm, or the like. These are stable, with no steam and no burn. Natural gas may be injected above the water seal to cause a reforming reaction, to transform a bad oxidizer to a good reductant (as the gas mixture gets hot $CH_4+H_2O=CO+3H_2$). This is illustrated in FIG. 6.

Third, post-RHF operation, grinding and separation of the chrome metal may be accomplished via magnetic separation or density differences. In fact, using the methods and systems of the present invention, ferrochrome is present in the RHF and a melter may not be needed given these separation technologies, with agglomeration in briquettes.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A method for reducing a chromium containing material, comprising:

combining the chromium containing material comprising chromium oxide with a carbonaceous reductant to form a chromium containing mixture in the form of agglomerates;

delivering the chromium containing mixture to a moving hearth furnace and reducing the chromium containing mixture to form a reduced chromium containing mixture;

delivering the reduced chromium containing mixture to a smelting furnace; and separating the reduced chromium containing mixture into chromium metal and slag;

wherein the agglomerates comprise one or more of an internal melting substance to increase the internal porosity and decrease the density thereof and extruded hollows of elongate shape.

2. The method of claim 1, further comprising agglomerating the chromium containing mixture in a granulator.

3. The method of claim 1, further comprising providing a carbonaceous atmosphere-adjusting agent on or proximate the chromium containing mixture.

4. The method of claim 1, further comprising providing a hearth-protecting material on or proximate the chromium containing mixture.

5. The method of claim 1, wherein the chromium containing mixture has an average particle size of less than about 200 mesh.

6. The method of claim 1, further comprising adding a binder to the chromium containing, mixture.

7. The method of claim 2, wherein the agglomerated chromium containing mixture comprises a barrier coating.

8. The method of claim 1, wherein the smelting furnace comprises an electric arc or induction furnace.

9. The method of claim 1, further comprising recycling off-gas from the smelting furnace to the moving hearth furnace as reducing gas.

10. The method of claim 1, further comprising adding hearth powder to the chromium containing mixture.

11. The method of claim 1, further comprising oxidizing the chromium containing mixture in a first zone of the moving hearth furnace to create a protective passive layer thereon.

12. The method of claim 1, further comprising injecting, natural gas into a cooling zone of the moving hearth furnace to prevent re-oxidation of the reduced chromium containing mixture during cooling.

13. The method of claim 1, further comprising utilizing a sealing liquid in the moving hearth furnace that prevents oxidizing conditions therein.

14. The method of claim 1, further comprising extracting chrome metal from the reduced chromium containing mixture using one or more of magnetic separation and density difference separation.

15. The method of claim 13, further comprising injecting natural gas proximate the sealing liquid to cause a reforming reaction to transform an oxidizer to a reductant.

* * * * *